United States Patent [19]

Brenner

[11] 4,213,394

[45] Jul. 22, 1980

[54] SPIN PROCESSING ACTIVE OPTICAL FUZE

[75] Inventor: Charles H. Brenner, Scottsdale, Ariz.

[73] Assignee: Motorola, Inc., Schaumburg, Ill.

[21] Appl. No.: 314,642

[22] Filed: Dec. 13, 1972

[51] Int. Cl.[2] ..... F45C 13/02

[52] U.S. Cl. ..... 102/213; 250/342; 250/316.1

[58] Field of Search ..... 102/70.2 R, 213; 244/3.16; 250/316, 341, 342

[56] References Cited

U.S. PATENT DOCUMENTS

| | | | |
|---|---|---|---|
| 3,145,949 | 8/1964 | Smith, Jr. | 244/3.16 X |
| 3,282,540 | 11/1966 | Lipinski | 244/3.16 |
| 3,332,077 | 7/1967 | Nard et al. | 102/70.2 R |
| 3,504,869 | 4/1970 | Evans et al. | 244/3.16 |
| 3,527,949 | 9/1970 | Huth et al. | 250/199 |

OTHER PUBLICATIONS

*Laser Doppler Radar,* Overhultz et al., IBM Tech. Disc. Bull., vol. 5, No. 3, Aug. 1962, pp. 59 & 60.

*Primary Examiner*—Peter A. Nelson

*Attorney, Agent, or Firm*—Eugene A. Parsons

[57] ABSTRACT

An optical target detecting device and system are disclosed wherein a single lens system projects a beam of infra red radiation and a single lens system picks up target reflections of this single radiation. Additional lens systems including reflectors are disclosed along with the single lens system to increase the frequency of received optical radiation from extraneous sources. Frequency discriminating means eliminate the effects of the extraneous radiations while receiving the optical reflections from the desired target.

7 Claims, 6 Drawing Figures

SPIN PROCESSING ACTIVE OPTICAL FUZE

BACKGROUND OF THE INVENTION

This invention relates to optical proximity fuzes and the like, more particularly to optical proximity fuzes which are able to distinguish between the target and extraneous optical radiations and it is an object of the invention to provide improved optical fuzes of this nature.

Proximity fuzes in the past have been applied to larger caliber shells, projectile, missiles or the like to give increased hit probability, such projectiles having sufficient caliber so as to accommodate the proximity fuze mechanism. The advent of semiconductor devices has enabled transmitting circuits and receiving circuits to be reduced to very small sizes, as a result of which proximity fuzes, according to the invention, can now be made for smaller caliber projectiles, for example such as those for the twenty, twenty-five and thirty milimeter rounds.

Accordingly, it is a further object of the invention to provide an improved optical proximity fuze of the nature indicated for application to small diameter projectiles.

Small diameter projectiles are typically used in automatic weapons which may be carried by gun ships, for example. Several such automatic weapons may be mounted upon each gun ship and many, if not all of them, may be firing at the same time. In such event, as in other events, a very large number of shells may be fired in short intervals of time thereby rendering such operations quite expensive. Accordingly, it is a further object of the invention to provide an improved optical proximity fuze of the nature indicated which is inexpensive to make and reliable in operation.

It is a further object of the invention to provide an improved optical proximity fuze of the nature indicated having simple electronics through the elimination of any pulse or modulated transmitter.

It is a further object of the invention to provide an improved optical proximity fuze of the nature indicated which rejects false triggering on clouds and other extraneous optical radiation sources and is immune to counter measures.

SUMMARY OF THE INVENTION

In carrying out the invention according to one form, there is provided an optical target detecting device adapted to be carried by a projectile and to rotate therewith about the projectile spin axis comprising a projectile nose cone, means for directing optical radiation from said nose cone at an angle to such projectile spin axis, means on said nose cone for receiving optical reflections of said optical radiation from a target, means responsive to said received reflections for developing firing signals under predetermined conditions, and means on said nose cone for eliminating the effects of extraneous optical radiation beams impinging on said receiving means.

In a preferred form of the invention the means for eliminating the effects of extraneous optical beams may comprise means for increasing the frequency of said extraneous beams.

In carrying out the invention according to another form, there is provided an optical target detecting device adapted to be carried by a projectile and to rotate therewith about the projectile spin axis comprising a projectile nose cone, a source of optical radiation in said nose cone, first lens means on said nose cone for directing a beam of said radiation at an angle to said spin axis and toward a target, a plurality of second lens means on said nose cone disposed axially rearwardly of said first lens means and disposed circumferentially with respect to each other for receiving reflections of said optical radiation from said target in one of said second lens means and for receiving optical radiations from extraneous sources through all of said second lens means, one of said second lens means being coplanar with said first lens means and said spin axis, means responsive to the optical radiation received said first and said second lens means for developing electrical firing signals, and means for eliminating from said electrical signals the components corresponding to the optical radiations from said extraneous sources to develop a final electrical firing pulse.

DESCRIPTION OF THE PREFERRED EMBODIMENT

Figure 1:
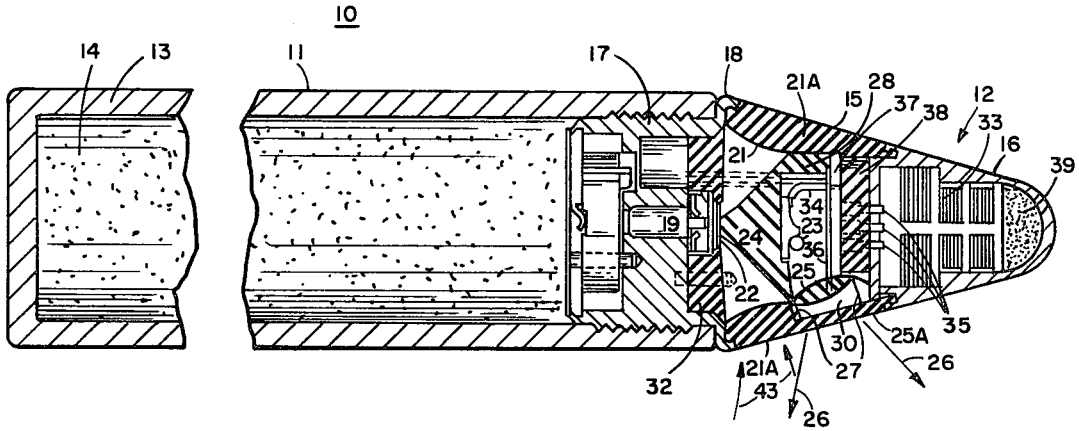
FIG. 1 is a sectional view of a shell including an optical proximity fuze according to the invention.

Referring to the drawings the invention is shown embodied in an ammunition round 10 including a shell 11 and a projectile 12. The shell 11 comprises a housing 13 in which is disposed some suitable explosive 14, and the projectile 12 includes the optical proximity fuze and firing mechanism as will be described.

The projectile 12 comprises a nose cone having two parts 15 and 16 coupled together as shown, the nose cone part 15 being connected to a base 17 by a suitable crimp connection 18 or otherwise.

The base 17 is threaded, as shown, for reception in corresponding threads formed in one end of the casing 13 as is well understood. The base 17 also includes an electric detonator 19 to be detonated by the firing mechanism to be described. When the detonator 19 is fired, the explosive charge 14 inside the casing 13 is fired by mechanism which is well understood, but which forms no part of this invention, and will not be further described.

The nose cone part 15 is a frustum of a cone which is coaxial with the rotational axis of the round 10 and the projectile 12. The nose cone part 15 has a smooth outer conical surface and is made of transparent material such, for example, as any synthetic or plastic material. The inner part of the nose cone portion 15 is curved to form a lens 21 which extends all around the interior portion of the cone and is in effect a surface of revolution with respect to the axis of the projectile, i.e. a cylinder. The lens 21 may be formed during the molding process if that is the manner of forming the nose cone part 15, or, it may be machined, or formed, in any other way after the nose cone part has been formed. The curvature of the lens surface 21 is such as to focus light coming in through the transparent nose cone part 15 to the central, or axial, point of the nose cone part 15 at which area a light sensitive, for example, a silicon diode 22 is located.

The light source which may be an infra red light 23, for example, a light emitting diode, is attached to a support member 24 interiorly of the nose cone part 15. The infra red radiation from the light emitting diode 23 is projected by means of a lens 25 through the transparent walls of the nose cone part 15 and into space as shown by the radiating arrows 26. The lens 25 may be molded of synthetic or plastic material, in which molding process, supports or legs 27 may be formed. The latter support the lens in a rectangular, supporting structure in the interior wall of the nose cone portion part as may be seen best in FIGS. 1 and 2.

The exterior surface of the nose cone part 15 is flat or smooth, as already indicated, and shields the surface of the lenses 21 and 25 from the atmosphere. The aerodynamic characteristics of the projectile 12 are thus not interfered with. In a preferred embodiment of the invention, a single lens 25 is used.

The internal support member 24 includes a hollow cylindrical portion 28 relatively snugly received within a corresponding interior cylindrical surface of the nose cone portion 15, the infra red radiating diode 23 being disposed within the hollow of the cylindrical portion 28. Extending from and continuous with the cylindrical portion are four lugs or protuberances 29 separated by slots or grooves 31. The exterior surfaces of the lugs 29 are curved to fit the curvature of the cylindrical lens 21 as may be seen best in FIG. 1. The cylindrical portion 28 and the lugs or protuberances 29 together with the slots or grooves 31 may be formed as part of the molding process, for example, of the support member 24.

The slots or grooves 31 as shown comprise three essentially trapazoidal surfaces 31A, B and C. The surfaces 31A and 31C lie essentially in radially disposed planes while the surface 31B lies essentially in a plane transverse, or at an angle, to the axis of the cone. In any event, the surfaces 31A, 31B and 31C are disposed so as to reflect essentially all of the light which enters through those parts of the lens 21 which are adjacent the openings of the particular slots 31 to the central area of the support member. That is, all the entering light is either reflected or directed to impinge on the silicon diode (photosensitive diode) 22. When the support member 24 is disposed interiorly of the nose cone part 15, the lugs 29 in resting against interior lens portion 21 will divide the volume at this end of the nose cone part 15 into regions admitting light radiation, and other light, separated by regions of opacity. According to a preferred embodiment of the invention there will be four lugs 29 separately alternately by four slots 31 so as to have four light receiving areas separated by four opaque regions. One of the slots or grooves 31 is disposed opposite a lens portion 21 such that the axis of that lens portion and the axis of the lens 25 are in the same plane as the axis of the projectile 12.

The photodiode 22 may be attached to a further internal support ring 32 which in turn is supported within the base member 17 as shown.

The infra red emitting source 23 is supplied with energy from a thermal battery 33, for example, supported inside of the nose cone part 16, conductors 34 and connecters 35 serving this purpose.

The circuitry 36 for processing the signals developed by the photodiode 22 may be of the integrated circuit variety and be held on a substrate 37 supported on a support member 38 as shown. The integrated circuit 36 held on the substrate 37 does not form a specific part of the invention and is not specifically shown for that reason. The battery 33 normally is inoperative because the electrolyte has not been supplied to the plates. The electrolyte 39 exists in solid form in the very nose of the nose cone. After the projectile has been fired, the heat of friction with the air causes the electrolyte 39 to melt and to flow into the thermally actuated battery 33. Thereupon a voltage is developed which energizes not only the infra red radiating source 23 but the other circuitry in the inventive device. If desired, the battery may be actuated, other than thermally.

Figure 2:
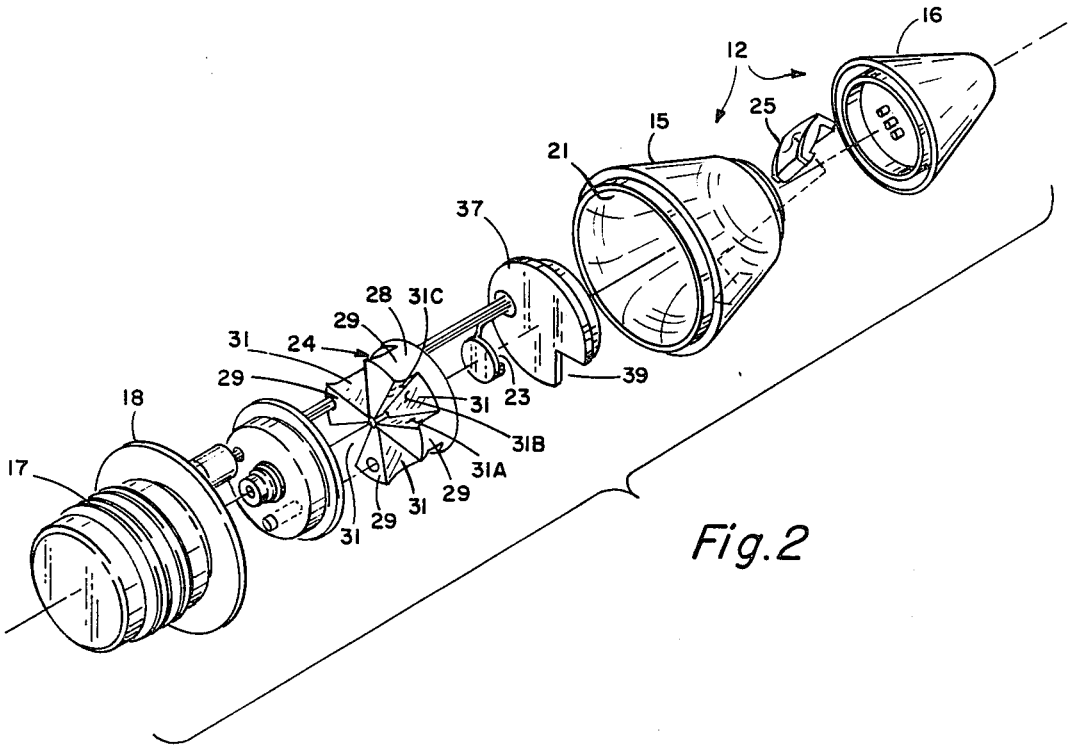
FIG. 2 is an exploded prospective view of the components forming the optical proximity fuze.

The supporting member 37 includes a notch 41 as may be seen best in FIG. 2 which provides a space for the radiation from the infra red source 23 to project outwardly through the lens 25 and toward the target.

Figure 3:
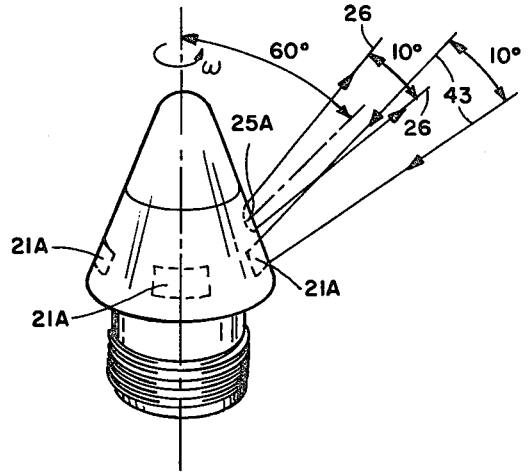
FIG. 3 is a perspective view of the fuze according to the invention in assembled form.

Referring to FIG. 3, the area 25A on the exterior of nose cone part 15 illustrates the location of the transmitting lens interiorly of the nose cone, and the dotted areas 21A illustrate the location of three of four receiving lenses 21 in the nose cone part 15.

Figure 5:
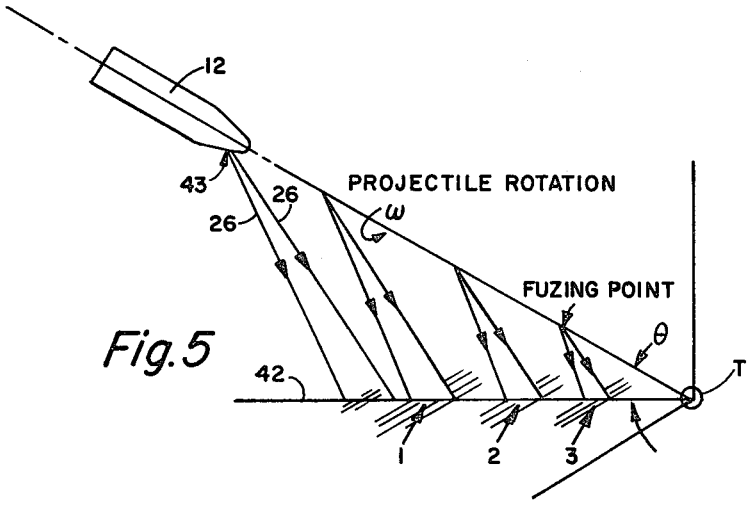
FIG. 5 is a further diagram illustrating operation of the invention.

Thus it may be observed that as the projectile approaches a target, as visualized in FIG. 5, the infra red radiation 26 projecting outwardly from lens 25 to the ground 42 is reflected back (arrows 43) and is received through one of the lens areas 21A (FIGS. 1, 3 and 5). After that particular lens area 21A (and lens 21), in the same plane as lens area 25A and lens 25, rotates so as to be out of view of the ground during that revolution, no further infra red radiation as a result of reflections of the radiations from the source 23 will be received by any of the areas 21A and lenses 21 during that revolution.

However, any light radiating source such for example as the sun, bright clouds, etc., in the vicinity would transmit their own optical radiation including infra red through each of the areas 21A and lenses 21 as the projectile rotates about its spin axis in its pathway toward the target. Thus extraneous light sources such as the sun or clouds will transmit four times as many optical radiation pulses to the light sensitive diode 22 as compared with the active radiation and reflection from the radiating source 23. By way of example, the radiating beam shown by the arrows 26 is shown to be about ten degrees in width at an angle of sixty degrees to the spin axis of the projectile, and the angle of reception of radiation by the areas 21A and lenses 21 is also shown as being of about ten degrees in width, in essence, at about sixty degrees to the axis of rotation.

Figure 4:
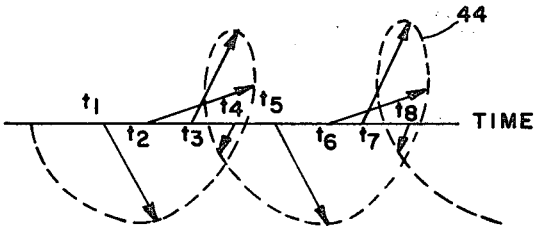
FIG. 4 is a diagram useful in explaining the operation of the invention.
Figure 6:
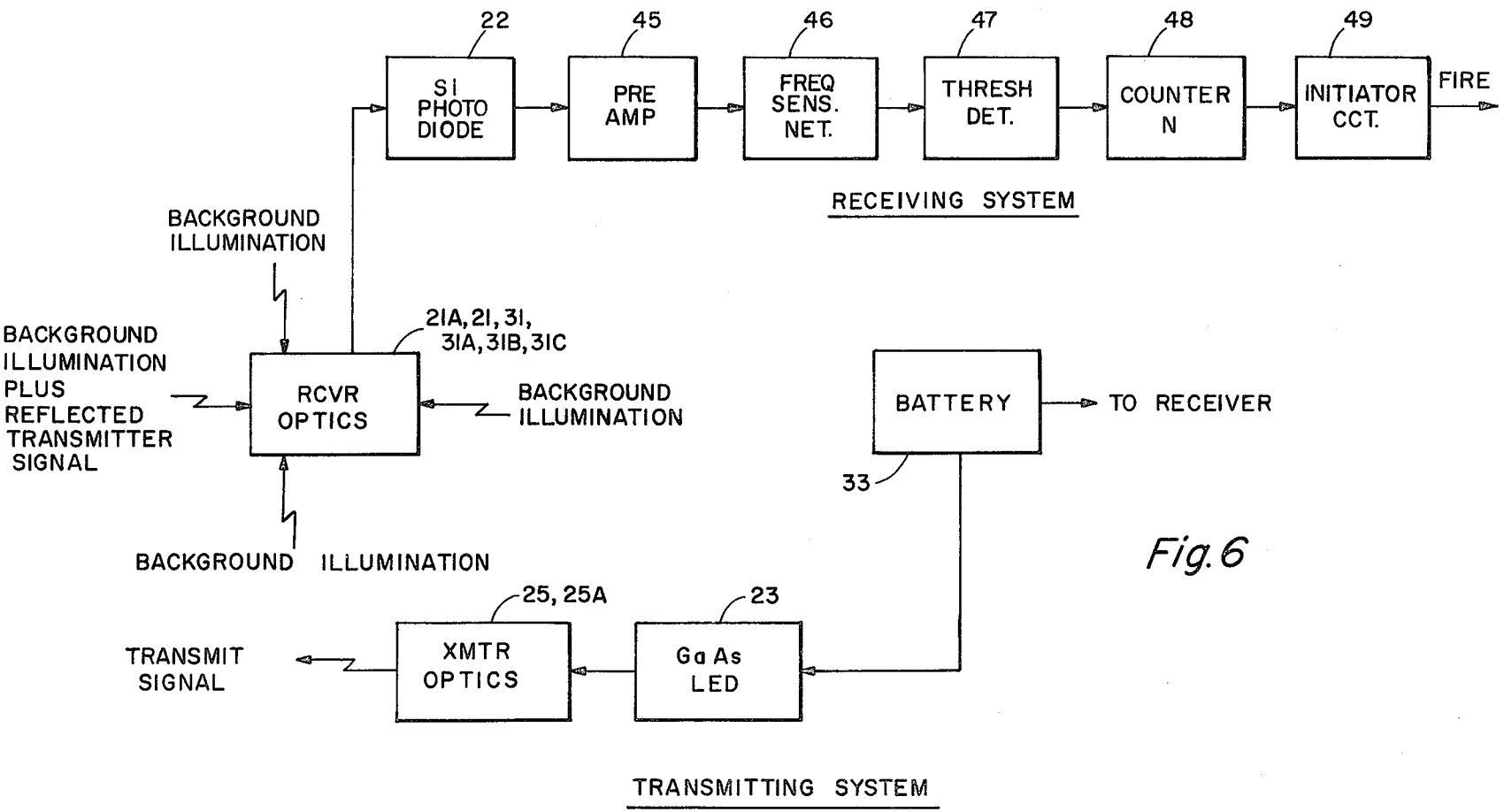
FIG. 6 is a block diagram of one form of circuit for carrying out the invention.

In summary the optical sensor or proximity fuze, according to the invention, operates as an active system, shown by the block diagram of FIG. 6, in which initiation occurs when the receiving system detects transmitted optical energy reflected from a near surface target. The transmitter 23, 25 utilizes a light emitting diode 23 (LED) operating directly from a battery to produce a steady DC or unmodulated source of infra red energy. The transmitter optical system, for example, uses a single molded lens 25 to form a directive beam 26 with a ten degree included angle located so that it makes an angle of sixty degrees with the spin axis of the projectile as shown in FIG. 3. As the projectile 12 travels, its linear and angular velocities cause the volume illuminated by the transmitter beam 26 to trace out a spiral or corkscrew pattern 44 as shown in FIG. 4. At times $t_1$ and $t_5$ the transmitter beam is contained within the vertical plane and pointed down while at time $t_3$ and $t_7$ it is in the same plane but pointed up. Similarly, at times $t_4$ and $t_8$ the transmitter beam is contained in horizontal plane and directed out of the paper while at times $t_2$ and $t_6$ it is in this same plane but directed into the paper.

The receiving system, as shown in FIG. 6 comprises the receiver optics 21, 21A etc., the photodiode 22, a preamplifier 45, a frequency sensitive or discriminating network 46, a threshold detecting network 47, a counter network 48 whose number of counts N can be preset and a firing pulse initiating circuit 49. All of these components which comprise the signal processing circuit may be of well known form and may be part of the integrated circuitry 36 on substrate 38.

Consider the operation of the optical sensor as it approaches a target at an impact angle $\theta$ as is shown in FIG. 5. The system sensitivity of the optical sensor is designed in a well known manner, as by design of the threshold detector 47 to produce a range cutoff at ranges along the transmitter beam 26 of approximately six feet. This range may be termed the "optical range" to distinguish between the slant range to the target and height above the surface of an ideal target. When the projectile is far from impact, the target returns, from the ground 42 in the specific case, are below the system threshold but as the sensor approaches the target, a point is reached at which the threshold detected by detector 47 is exceeded as is shown by region 1 in FIG. 5. The duration of the first threshold exceedance is generally rather short because the optical range is within the detection threshold for only a small fraction of the time required for one revolution of the projectile. Each succeeding revolution of the projectile brings it closer to the target surface (specifically, ground) and therefore, the fraction of each revolution during which the threshold is exceeded increases as can be seen by comparing regions 1, 2 and 3 in FIG. 5. The receiver signal processing circuit senses (counter 48, N=3) when three consecutive threshold exceedances have occurred and uses this information to initiate activation of the firing pulse.

For greatest lethality, the shell should explode from one foot to five feet from the actual target such as soldiers either lying or standing. This is achieved by the system sensitivity which cuts off for signal returns at an optical range to ground of about six feet.

It is necessary to discriminate against, or eliminate, more than just the effects of the ambient day light. The latter is in effect a plane of light, or a universe of light, which the system must ignore. Systems which do this are known. But this is not enough. The system must discriminate against extraneous discreet sources of light radiation other than the desired target. The inventive system achieves this by increasing the frequency of the received signals from the extraneous discrete sources as compared with those of the target.

Bright sources of radiant infra red energy such as the sun or possibly even some highly reflective areas of terrain or clouds could produce threshold exceedances at the projectile spin rate. these undesired signals are rejected through the use of the multi-element (24) receiving optical system which produces four beams spaced at ninety degree intervals around the axis of the fuze. In FIG. 3 portions of three of the four receiving apertures 21 are visible. The use of four receiving apertures causes undesired infra red sources to produce signal returns at four times the spin rate of the projectile. Since this rate is sufficiently greater than the rate of a true return caused by illumination from the transmitter, frequency rejection techniques (46) are used to prevent false triggering due to these interferring sources. There is a limit to the number of receiving apertures and reflector segments, because, as their number increases the ratio of darkness to light seen by the photodiode 22 becomes constant and it sees only a constant level of light. That is it sees a plane, or disk of light, depending on the dimensions of reflecting segments. A definite increase and decrease of light at a higher frequency than the target must be seen.

The transmitter contains only two components, an LED 23 and a resistor (not shown), that are connected in series across a single cell of the thermal battery 33. No voltage regulator is used because the reduction in battery voltage and current with increasing flight times corresponds with the desirability of having reduced optical range when the projectile is moving slower. An immersion lens in contact with the LED and an objective lens 25 are used to form a conical beam with a ten degree included angle.

The receiver uses a silicon PIN photodiode 22 onto which energy from all four receiving apertures is focused. A high input impedance preamplifier 45 drives a bipolar amplifier (not shown) to produce a nominal signal level of one volt. An amplitude leveling circuit, as part of the amplifier circuitry 45, assures that signals produced by an intense background source are limited to an amplitude comparable to the minimum signal return from a true target. After amplitude equalization, a frequency discrimination network 46 selects the desired signal frequency and produces a firing circuit pulse output after an adequate number of pulses N are received (counted). Signals produced by the background illumination are rejected because they occur at four times the desired signal rate.

Polysulfone, or a similar material, which has high temperature resistance, good optical transmission efficiency, and a high index of refraction and is injection moldable, is used for the multi-element reflector 24. The reflecting surfaces 31A, 31B and 31C are formed by vacuum depositing silver, gold, or copper, for example, on the surfaces to achieve a high efficiency in the multi-element reflector.

At assembly, the transmitter diode 23 is bonded to the internal central region of the multi-element reflector 24 which is, in turn, positioned against stops inside of the cone part 15. The ceramic substrate 37 containing the processing circuits is bonded to the top side of the element 24. The substrate containing the receiving photodiode 22 is bonded to the back side of the multi-element reflector and the diode itself may be bonded to the central portion of supporting member 24.

The optical sensor responding to infra red radiation or other light radiation is insensitive to any ground controlled microwave or similar countermeasure signals. It will also be insensitive to any microwave radiations from any other projectiles or moving sources.

What is claimed is:

1. An optical target detecting device adapted to be carried by a projectile and to rotate therewith about the projectile spin axis comprising, a projectile nose cone, a source of optical radiation in said nose cone, first lens means on said nose cone for directing a beam of said radiation at an angle to said spin axis and toward a target, a plurality of second lens means on said nose cone disposed axially rearwardly of said first lens means and disposed circumferentially with respect to each other for receiving reflections of said optical radiation from said target in one of said second lens means and for receiving optical radiations from extraneous sources through all of said second lens means, one of said second lens means being coplanar with said first lens means and said spin axis, means responsive to the optical radiation received said first and said second lens means for developing electrical firing signals, and means for eliminating from said electrical signals the components corresponding to the optical radiations from said extraneous sources to develop a final electrical firing pulse.

2. An optical target detecting device according to claim 1 wherein said first lens means comprises a single lens means.

3. An optical target detecting device according to claim 2 wherein said second lens means comprises more than one lens means and fewer than a number of lens means corresponding to a uniform plane of optical radiation.

4. An optical target detecting device according to claim 1 wherein said eliminating means comprises frequency responsive means.

5. An optical target detecting device according to claim 4 wherein said means for developing firing signals comprises a radiation sensitive diode and a signal processing circuit.

6. An optical target detecting device according to claim 5 wherein said signal processing circuit includes threshold detecting means.

7. An optical target detecting device according to claim 6 wherein said signal processing circuit further includes counter means for determining the number of times the firing signals exceed the threshold.

* * * * *